United States Patent [19]

Simon et al.

[11] 4,356,937

[45] Nov. 2, 1982

[54] SYRUP DISTRIBUTION SYSTEM

[75] Inventors: Donald R. Simon, Wayne, N.J.; Salvatore P. Porrazzo, Wilton, Conn.

[73] Assignee: PepsiCo. Inc., Purchase, N.Y.

[21] Appl. No.: 207,650

[22] Filed: Nov. 17, 1980

[51] Int. Cl.[3] ..... B67D 5/66

[52] U.S. Cl. ..... 222/129.2; 222/136; 222/81

[58] Field of Search ..... 222/129.2, 136, 144.5, 222/145, 132, 135, 81, 80, 130; 137/266

[56] References Cited

U.S. PATENT DOCUMENTS

| | | | |
|---|---|---|---|
| 494,061 | 3/1893 | Day | 222/145 X |
| 721,854 | 3/1903 | Beiser | 222/136 X |
| 2,253,884 | 8/1941 | Beecher | 222/135 X |
| 2,256,550 | 9/1941 | Colvin | 222/136 |
| 2,774,393 | 12/1956 | Swan | 141/330 X |
| 3,976,227 | 8/1976 | Ray | 222/145 X |
| 4,120,420 | 10/1978 | Dirksing | 222/81 X |

*Primary Examiner*—Allen N. Knowles
*Attorney, Agent, or Firm*—Scully, Scott, Murphy & Presser

[57] ABSTRACT

A syrup distribution system for fountain service wherein a sheet metal rack supports a plurality of bag/-box syrup containers, each of which includes an outer corrugated cardboard box and an inner flexible film pouch or bag containing the syrup. The sheet metal rack includes a lower shelf for storing a plurality of extra syrup containers, while the middle and upper shelves are equipped with a manifold for connection to the syrup containers thereon. Each bag/box container is connected to the manifold via a connecting tube having a probe which punctures a seal in the container, and a check valve is utilized to control the flow of syrup from each container into the manifold. A bleeder valve is connected at one end of each shelf manifold to assist in purging air from the system, and syrup flows from the manifolds to a syrup distribution pump which supplies it to the fountain service head. In operation of the system, after the containers on one shelf of the rack are emptied of syrup, a valve at the syrup pump is switched to a second set of containers on a second shelf, thereby allowing replacement of the empty syrup containers on the first shelf.

8 Claims, 2 Drawing Figures

SYRUP DISTRIBUTION SYSTEM

BACKGROUND OF THE INVENTION

1. Field of the Invention

The present invention relates generally to a syrup distribution system for a fountain service head for carbonated soft drinks. More particularly the subject invention pertains to a syrup distribution system employing a unique type of disposable syrup container and a novel arrangement facilitating usage and storage of the disposable syrup containers in fountain service.

2. Discussion of the Prior Art

Syrup distribution systems for fountain service are known in the prior art in which five gallon reusable stainless steel syrup containers are interconnected and are used in conjunction with a pressurized carbon dioxide source to deliver syrup to the fountain service head. These known distribution systems suffer from a number of disadvantages including a significant initial expense associated with the purchase of stainless steel syrup containers for new accounts, as well as the expense of shrinkage replacement of the containers. Additionally, these prior art arrangements are relatively inconvenient, requiring the return and transportation of containers depleted of syrup back to a syrup distributor for refill thereof and return to the fountain service.

The prioar art in this field is relatively crowded, and discloses many alternative distribution arrangements for delivering or dispensing liquids of various types.

Swan U.S. Pat. No. 2,774,393 discloses a wire rack construction for a multiple variety dispensing arrangement for liquids in which individual liquid storage containers may be selectively removed from and replaced on the wire rack. The arrangement includes a container pressurizing device having a puncturing element provided with sharp cutting edges such that a supply container may be inserted onto the rack and forced downwardly, thereby forcing the puncturing element to penetrate the supply can, and allowing the liquid contained therein to flow through channels downwardly into a storage receiver. Upon exhausting the supply of fluid from any container, the depleted container is removed from the wire rack, and another container is replaced in its position to enable a fresh supply of fluid to be supplied to one of several dispensing spigots located at the front of the dispenser.

Ray U.S. Pat. No. 3,976,227 illustrates a portable dispensing cart which supports upper and lower groups of storage tanks containing liquid chemicals. A gas supply manifold is coupled in parallel to the tanks to force the contents thereof to flow into a liquid manifold. Individual upper and lower storage tanks are coupled together to provide tank pairs, with the tank pairs being coupled in parallel between the gas manifold and the liquid manifold to provide the capability of a high flow rate for the liquid chemical.

Colvin U.S. Pat. No. 2,256,550 relates to a dispensing arrangement for dispensing a liquid such as beer from a plurality of relatively large containers. The bottles of beer are coupled through a common manifold system to a single dispenser tap, and the individual bottles receive carbon dioxide under pressure through the manifold to pump the liquid contents thereof to the dispenser tap.

Slagle U.S. Pat. No. 3,390,598 discloses a dispensing arrangement for sequentially supplying liquid from a plurality of individual containers by means of gravity feed. A manifold has a plurality of containers disposed therealong, and the contents of the containers are forced by gravity to the manifold. Each container receiver includes means for supporting as associated container in an inverted position such that the containers have their liquid outlets positioned at different vertical heights from each other. Each container includes a liquid flow valve to selectively close the liquid flow therefrom.

SUMMARY OF THE INVENTION

Accordingly, a primary object of the present invention is the provision of a syrup distribution system for fountain service which eliminates much of the inconvenience and expense of similar syrup distribution systems now in commercial usage.

A further object of the subject invention is to provide a fountain service syrup distribution system utilizing syrup supplied in disposable plastic bag containers. Each plastic bag container is formed as a flexible film pouch to provide chemical and biological isolation of its syrup contents, and is housed within a protective outer container which may be constructed of corrugated cardboard to provide for convenient handling and shipment of the syrup container.

Yet another significant object of the present invention is the provision of an arrangement for conveniently handling the distribution of fluid supplied in disposable containers of the aforementioned type.

In accordance with a preferred embodiment, a distribution system is disclosed for supplying fluid from discrete supply containers in which first and second shelves are adapted to hold a plurality of fluid containers. Each of the shelves has a supply manifold associated therewith having a plurality of input conduits along its length for connection to the supply containers. A distribution valve is connected to both supply manifolds, and couples one or the other manifold to the output of the system. In greater detail, each supply container is disposable, and is formed by an outer rectangular block of corrugated cardboard and an inner plastic bag which provides chemical and biological isolation for the fluid stored therein. Each plastic bag is provided with a sanitary fitment designed to be punctured by a probe connected to an aforementioned input conduit to a supply manifold, such that puncturing of the fitment with a probe provides access to the contents of the container. Moreover, in a preferred embodiment the first and second shelves form the upper and middle shelves of a supply rack, while a third bottom shelf is provided for storage of spare supply containers. A pump is coupled to the output of the distribution valve, and in a preferred embodiment is powered by a tank of compressed carbon dioxide gas which also serves to carbonate water with which the fluid is mixed. This arrangement is particularly advantageous in a syrup supply system for fountain service, whereby the arrangement requires only a source of tap water, the syrup distribution system and a tank of pressurized carbon dioxide, thus eliminating the requirement for electrical service which is particularly advantageous in many dispensing environments. In the preferred embodiment, each supply manifold is supplied with a vent valve for venting air from the manifold which may become trapped therein.

Accordingly, a further significant object of the subject invention is the provision of novel syrup distribution arrangement facilitating the usage and storage of disposable syrup containers in fountain service.

BRIEF DESCRIPTION OF THE DRAWINGS

The foregoing and other objects and advantages of the novel syrup distribution system constructed pursuant to the teachings of the present invention may be more readily understood by one skilled in the art, having reference to the following detailed description of a preferred embodiment thereof taken in conjunction with the accompanying drawings wherein identical reference numerals are utilized to refer to like elements in the several views, and in which.

DETAILED DESCRIPTION OF THE DRAWINGS

Figure 1:
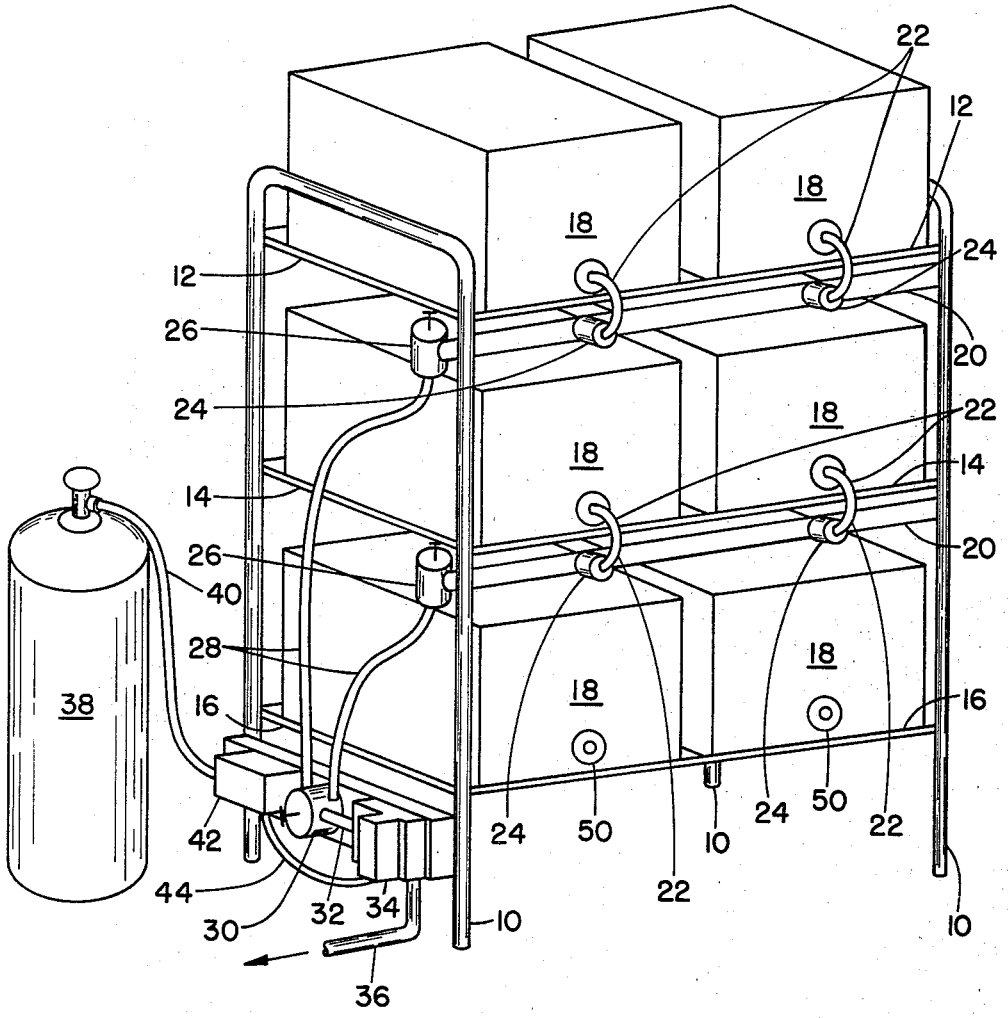
FIG. 1 is a perspective view of one embodiment of a syrup distribution system constructed pursuant to the teachings of the present invention.
Figure 2:
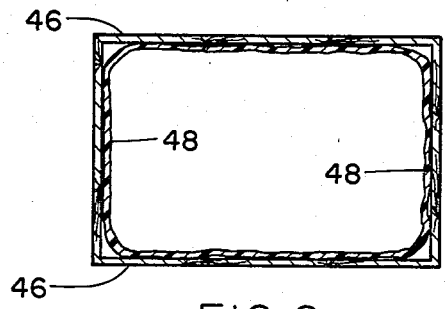
FIG. 2 is an elevational sectional view through one of the disposable syrup containers shown in FIG. 1.

Referring to the drawings in detail, the figure illustrates a syrup distribution system for fountain service wherein a sheet metal rack is constructed of side frame members 10 and upper, middle, and lower shelves, designated respectively as 12, 14 and 16. Each of the side frame members may be constructed of tubular steel stock bent or formed into an inverted U shape such that the projecting legs of the U form the side legs of the metal rack. The upper, middle and lower shelves 12, 14 and 16 may be constructed of sheet steel having the edges thereof bent over to form reinforced frame portions. The side frame members and the several shelves are assembled into on integral unit by standard assembly techniques such as by welding or by bolting the components together. Although not illustrated, the four corner legs of the side frame members can be provided with wheels or casters to provide a portable cart type of arrangement.

Each of the upper and middle shelves 12 and 14 supports two syrup containers 18 which are of a sepcial type of construction described in further detail below. Each of the upper and middle shelves 12 and 14 also includes a shelf manifold 20 which is coupled to each syrup container via a connecting tube 22. The manifolds 20 have a check valve 24 at the point of attachment of each connecting tube 22 to prevent the flow of syrup from the manifold when only one container is attached thereto, a common situation during container replacement as the containers are normally replaced in pairs. Furthermore, each shelf manifold 20 includes a bleeder valve 26 positioned at the end toward which syrup flows to allow trapped air to be purged from the manifold as it is filled with syrup during a set-up operation.

Each manifold is connected via tubing 28 to a supply or switch-over valve 30 which allows either of the top or bottom manifolds to be connected as a supply source. The output of the switch-over valve 30 is directed via output tube 32 to a syrup distribution pump 34 which pumps the syrup through tube 26 to a fountain service head. A typical fountain service includes an arrangement for mixing metered quantities of syrup with carbonated water, several different types of which are known and available in the prior art and in commerce. In the illustrated embodiment, the distribution pump 34 is driven by gas supplied under pressure from a pressurized carbon dioxide tank 38 operating through a supply hose 40, pressure reduction valve 42 and a further supply hose 44.

This arrangement wherein a tank of pressurized carbon dioxide drives pump 34 is particularly advantageous in many dispensing situations as the same tank of carbon dioxide may also be utilized to carbonate water for the fountain service. Accordingly, the fountain service requires only a source of tap water, the syrup distribution system and a tank of pressurized carbon dioxide, thus eliminating the requirement for electrical service, a particularly advantageous feature in many dispensing environments. In alternative embodiments, the distribution pump 34 may be driven by other sources of power. For instance, an electrically driven peristaltic or diaphragm pump may be utilized instead of a gas pressure driven pump. Furthermore, some pumping arrangements might incorporate a surge tank to prevent the system from becoming oscillatory in an unstable manner. In some situations a gravity feed arrangement might be sufficient, thereby eliminating the need for any type of syrup pump.

The bottom shelf 16 of the sheet metal rack is provided primarily for the convenient storage of replacement containers 18 of syrup. Although the illustrated embodiment has three shelves, two of which have supply manifolds and the third of which is provided primarily for storage, other arrangements are also contemplated having either a lesser or greater number of shelves of a different mix of supply and storage shelves. Moreover, the number of syrup containers 18 on each shelf may also be different in alternative arrangements.

The construction of the unique disposable syrup containers 18 disclosed herein will now be described in detail. Each disposable container includes an outer protective container 46 which may be constructed of corrugated cardboard, or other equivalent material, to provide for convenient handling and shipment of rectangularly shaped syrup containers. A disposable plastic bag or pouch 48 is positioned within each outer corrugated cardboard container 46, and provides for isolated containment of the syrup. The plastic bag container is formed as a flexible film pouch to provide chemical and biological isolation of its syrup contents. Each plastic bag is initially expanded to substantially its full volume as it is filled with syrup, and gradually collapses within the outer corrugated container as it is emptied of its contents during subsequent dispensing operations. Each pouch has a sanitary fitment 50 provided at an access opening in the outer corrugated container which is provided to connect the inner flexible container with the shelf manifold. The sanitary fitment of each pouch is configured to provide optimal entrance and evacuation characteristics when punctured by a probe connected to the flexible coupling 22 of the shelf manifold,. During connection of the container to the flexible coupling, a probe punctures a seal in the sanitary fitment thereby coupling the container to the manifold. The construction of the sanitary fitment or seal may be of the type currently sold commercially by Container Technologies, Inc., while the puncturing probe may be any design compatible with the seal.

In operation, the supply valve 30 is initially connected to allow syrup to be dispensed from the upper or middle shelf of the distribution system, and supplies syrup until the syrup containers on that shelf are emptied. At that time, the supply valve 30 is switched to connect the other of the top or middle shelf as a source of supply for the syrup distribution system. The empty containers from the previously coupled shelf are uncoupled from connecting tubes 22 to the shelf manifold, and are then replaced by the spare syrup containers 18 stored on the bottom shelf of the sheet metal rack. Upon placement of the full containers on the emptied shelf, the probe on the end of each connecting tube 22 is pushed through the corresponding seal on each replacement container to puncture the latter thereby providing access to the contents of the container. The check valves 24 prevent any leakage of syrup during this operation. The bleeder valve is then opened to release air that may have been introduced into the system during replacement of the containers. If available, further replacement containers 18 are restocked on the bottom shelf, and the syrup distribution system is then completely restocked at full capacity. The emptied containers may then be thrown away, or dispensed of in some other convenient manner.

Although a preferred embodiment of the present invention has been described in context with a distribution system for syrup at a fountain service, it should be apparent that the teachings herein have application for the distribution of other fluid products such as milk, juice and condiments including ketchup, mayonaise, mustard; etc. A preferred embodiment and several variations thereon have been disclosed in detail, and it is apparent that the generic teachings herein will suggest many alternative embodiments and variations to one skilled in this art.

What is claimed is:

1. A distributing system for supply of fluid from discrete supply containers and providing for replacement of empty containers without interruption of the fluid supply, comprising:

a. first and second shelves, each of which is adapted to hold a plurality of discrete fluid supply containers thereon;

b. first and second supply manifolds associated respectively with said first and second shelves, each of which has a plurality of input conduits therealong for connection to a plurality of discrete supply containers; and c. a distribution valve having a first inlet port connected to said first manifold and a second inlet port connected to said second manifold and having an outlet port connected to a fluid dispensing outlet and connecting only one inlet port at a time to the outlet port, such that fluid is supplied from the containers on either of said first and second shelves until the containers on that shelf are empty, at which time the distribution valve is switched to the other inlet port to supply fluid from the containers on the other shelf to allow replacement of the empty fluid containers without interruption of the fluid supply to the fluid dispensing outlet.

2. A distribution system for supply of a fluid from discrete supply containers as claimed in claim 1, including a plurality of discrete fluid supply containers, each container having an outer protective cardboard shell and an inner plastic bag container.

3. A distribution system for supply of a fluid from discrete supply containers as claimed in claim 2, said outer cardboard shell including a rectangular block of corrugated cardboard, and each container having a sanitary fitment adapted to be punctured by a probe coupled to one of said input conduits.

4. A distribution system for supply of a fluid from discrete supply containers as claimed in claim 3, including a third, bottom shelf for storage of spare supply containers, said first and second shelves being top and middle shelves in the system.

5. A distribution system for supply of a fluid from discrete supply containers as claimed in claim 4, including a pump coupled to the output of said distribution valve for pumping fluid to said outlet.

6. A distribution system for supply of a fluid from discrete supply containers as claimed in claim 5, said pump being powered by a container of compressed carbon dioxide gas, said container of compressed carbon dioxide gas also serving to carbonate water with which the fluid is mixed.

7. A distribution system for supply of a fluid from discrete supply containers as claimed in claim 1 or 6, said fluid being a syrup flavoring for a soft drink.

8. A distribution system for supply of a fluid from discrete supply containers as claimed in claim 7, each of said first and second supply manifolds having a vent valve for venting air from the manifold which may become trapped therein.

* * * * *